US012605607B1

(12) United States Patent
Gardner et al.

(10) Patent No.: US 12,605,607 B1
(45) Date of Patent: Apr. 21, 2026

(54) PITCHING PRACTICE MACHINE AND METHOD

(71) Applicants: Lucas E. Gardner, Estherville, IA (US); Charles R. Gardner, Estherville, IA (US)

(72) Inventors: Lucas E. Gardner, Estherville, IA (US); Charles R. Gardner, Estherville, IA (US)

( * ) Notice: Subject to any disclaimer, the term of this patent is extended or adjusted under 35 U.S.C. 154(b) by 0 days.

(21) Appl. No.: 18/924,574

(22) Filed: Oct. 23, 2024

(51) Int. Cl.

| | |
|---|---|
| ***A63B 69/00*** | (2006.01) |
| ***A63B 47/02*** | (2006.01) |
| ***A63B 69/40*** | (2006.01) |
| *A63B 102/18* | (2015.01) |

(52) U.S. Cl.
CPC ..... *A63B 69/0002* (2013.01); *A63B 47/025* (2013.01); *A63B 69/409* (2013.01); *A63B 2069/0006* (2013.01); *A63B 2102/18* (2015.10); *A63B 2102/182* (2015.10); *A63B 2214/00* (2020.08)

(58) Field of Classification Search
CPC ..... A63B 47/025; A63B 69/0002; A63B 69/0006; A63B 69/409
See application file for complete search history.

(56) References Cited

U.S. PATENT DOCUMENTS

| | | | | | |
|---|---|---|---|---|---|
| 2,280,376 | A * | 4/1942 | Clark | A63B 47/025 | 473/462 |
| 2,508,461 | A * | 5/1950 | Lemon | A63B 69/409 | 124/56 |
| 4,091,791 | A * | 5/1978 | Castelli | F41B 11/52 | 124/81 |
| 4,570,607 | A * | 2/1986 | Stokes | A63B 69/40 | 124/56 |
| 5,566,934 | A * | 10/1996 | Black | A63B 69/0002 | 473/431 |
| 6,167,878 | B1 * | 1/2001 | Nickerson | A63B 69/409 | 24/63 |
| 2004/0127308 | A1 * | 7/2004 | Swanson | A63B 69/0002 | 473/454 |
| 2007/0270250 | A1 * | 11/2007 | Burruss | A63B 24/0021 | 473/454 |

* cited by examiner

*Primary Examiner* — Bret Hayes
(74) *Attorney, Agent, or Firm* — McKee, Voorhees & Sease, PLC

(57) ABSTRACT

A machine catches a pitched baseball or softball, and pneumatically returns the ball to the pitcher without damage to the ball. The pitcher throws the ball into a mat hung inside a housing, which absorbs the ball impact, such that the ball drops onto a sloped floor and roles into a ball return tube. A pressurized air tank delivers air on demand by the pitcher to the tube to project the ball back to the pitcher. The machine is self-contained on wheels for portability.

20 Claims, 2 Drawing Sheets

PITCHING PRACTICE MACHINE AND METHOD

TECHNICAL FIELD

The invention is directed toward a machine for catching and pneumatically returning a pitched baseball or softball, and a method of pitching practice using the machine.

BACKGROUND

Athletes practice their sports to become better performers. Some sporting activities can be practiced alone, while others normally require one or more additional people. In baseball and softball, pitchers conventionally practice with a catcher who catches the pitched ball and throws it back to the pitcher repeatedly. While there are many benefits to having a live catcher for pitching practice, sometimes a catcher is not available. Machines are known for use in pitching practice, but these machines have various problems. For example, commercially available pitching machines are often heavy and difficult to move from a storage area to a practice area. Some machines utilize a target or backdrop made of materials which damages the baseballs and softballs. Some machines utilize one or two spinning wheels to project the ball back to the pitcher, but such wheels also can damage the ball surface, making them unsuitable for practice. Also, the ball return mechanism is mounted externally to the housing or target which catches the pitched ball, wherein such external location poses additional risk of damage to a ball which hits the return mechanism. For all these reasons, there is a need for an improved machine to aid in the training of baseball and softball pitchers, without the need of a person to catch and return the ball.

Accordingly, a primary objective of the invention is the provision of an improved machine to catch and pneumatically return a pitched baseball or softball without damage to the ball.

Another objective is the provision of a machine to catch a pitched ball and return it to the pitcher upon demand from the pitcher.

Still another objective is the provision of a method of practicing pitching without a catcher.

A further objective is the provision of a pitched ball catch and return machine which is an integral unit with wheels for easy movement and positioning.

Still another objective is the provision of a ball pitching practice and pitching practice or training method wherein the pitcher throws the ball against a mat, and the ball was returned via a pitcher-actuated switch.

Yet another objective is the provision of a machine to catch a pitched ball and return it pneumatically to preclude or minimize damage to the ball.

An additional objective is to provide a machine that simulates a throwback to the pitcher that closely resembles the same throw-back path with similar velocity as a real catcher.

These and other objectives become apparent from the following description.

SUMMARY

A machine to catch and return a pitched baseball or softball comprises a housing with an open front, a back wall, opposite side walls, a floor and a top. A mat hangs downwardly inside the housing to absorb impact from the pitched ball, which drops onto the floor. The floor is sloped downwardly and rearwardly to a tube connected to a pressurized air tank. A foot-actuated switch on the ground near the pitching rubber allows the pitcher to actuate the pneumatic ball return to project the ball back to the pitcher when the pitcher is ready. The housing and ball return mechanism are connected to form an integral unit which can be easily rolled on wheels connected to the housing from one location to another. The air tank is mounted on the exterior of the back wall of the housing. Indicia, such as lights, are operatively mounted on the housing to designate the pneumatic return mechanism has received the ball and is ready to project the ball to the pitcher. A ramp or sloped plate resides in front of the housing to direct low pitches into the housing.

A pitching practice or training method allows a baseball or softball pitcher to throw the ball against the mat hung in a housing, such that the ball drops to a sloped floor and rolls to a tube connected to a pressurized air tank. The pitcher then steps on a switch to actuate the air tank, whereby the ball is pneumatically ejected from the tube back to the pitcher. The mat and the pneumatic return minimizes or eliminates damage to the pitched ball.

DETAILED DESCRIPTION

Figure 1:
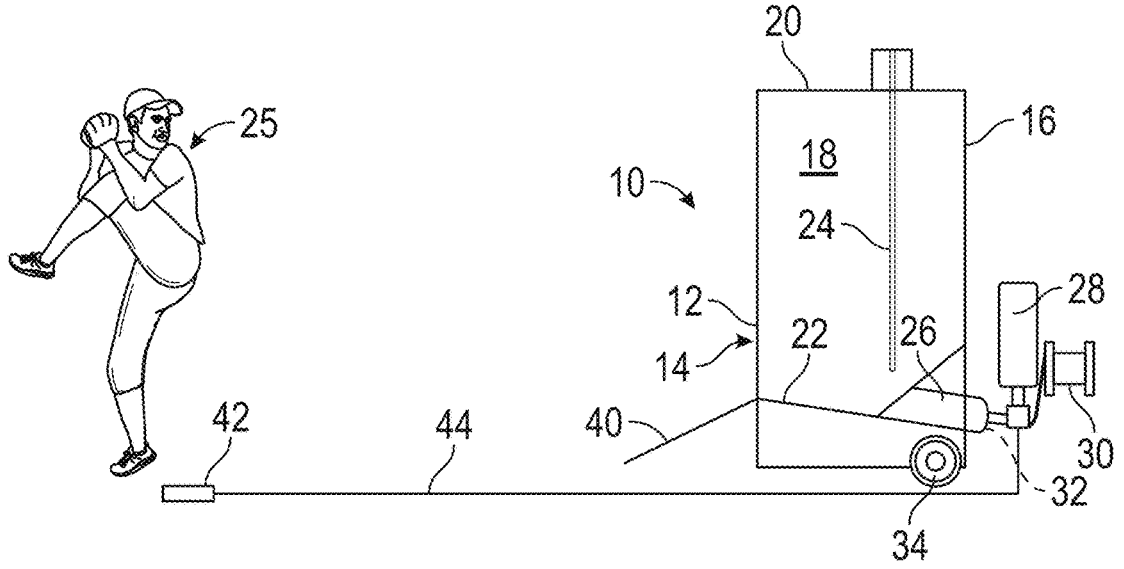
FIG. 1 is a schematic view showing the pitch practice and training machine of the invention.
Figure 2:
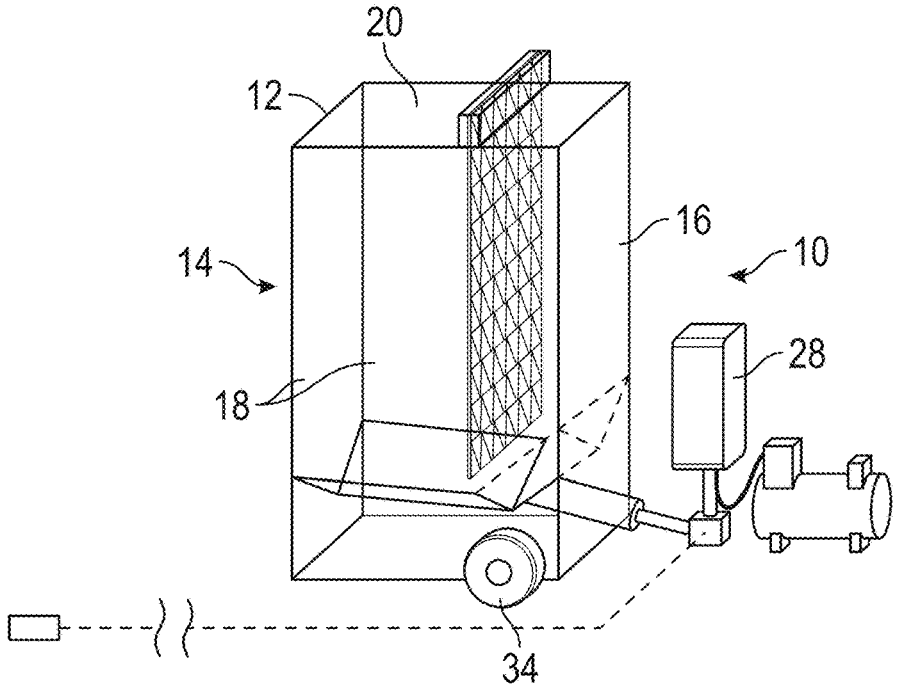
FIG. 2 is a perspective schematic view of the machine.
Figure 3:
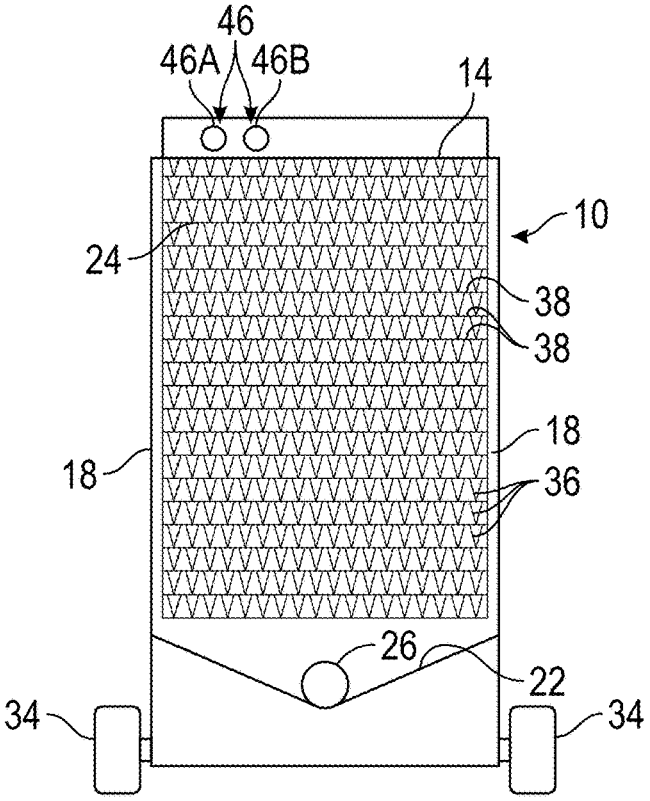
FIG. 3 is a front elevation view of the machine.
Figure 4:
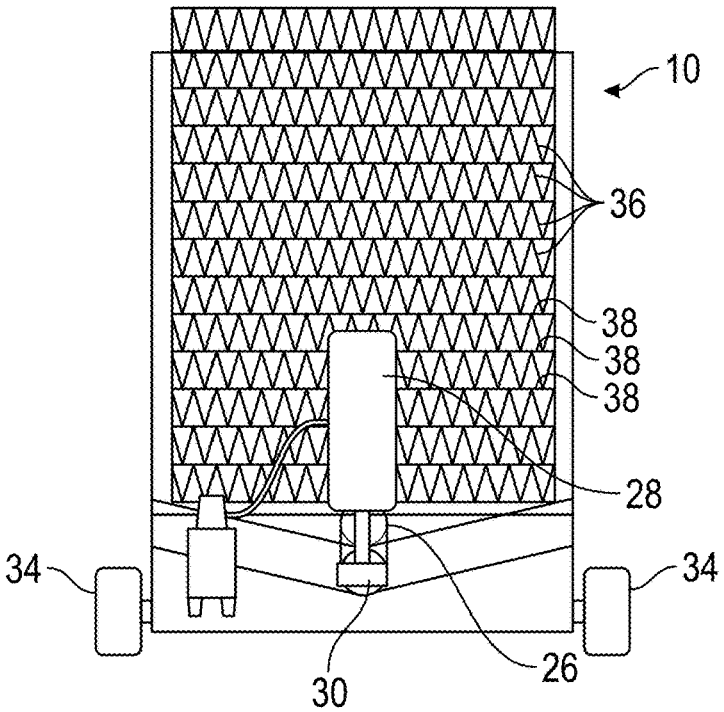
FIG. 4 is a rear elevation view of the machine.

A machine for catching and pneumatically returning a pitched baseball or softball is generally designated by the reference numeral 10 in the drawings. The machine 10 includes a housing 12 with an open front 14, a back wall 16, sidewalls 18, a top wall 20, and a floor 22. A mat 24 hangs downwardly inside the housing, in front of the back wall 16. The mat 24 defines a target for the pitcher 25. The bottom edge of the mat 24 is spaced above the floor 22 so that the ball can roll along the floor 22 beneath the mat 24 and into a tube 26 residing in a rear portion of the housing 12. The floor 22 is sloped downwardly and rearwardly from front to back, and is sloped downwardly from the sidewalls 18, as seen in FIGS. 1-3. The tube 26 is preferably sloped upwardly from back to front.

An air tank 28 and an air compressor 30 are mounted on the exterior back of the housing 12. The air tank 28 is operatively connected to a rear end of the tube 26 so as to exert a blast of air on a ball 32 in the tube 26, as further described below.

The housing 12 is mounted on wheels 34. The housing 12, air tank 28, and compressor 30 are assembled so as to form an integral unit that can be wheeled to a desired location, such as from a storage area to a practice area. The air tank 28 and compressor 30 can be mounted in any convenient location, preferably attached to the housing 12 for easy mobility of the machine 10.

The mat 24 is made of a ball damping material which stops the inertia of the pitched ball, which may have a velocity up to 120 mph. In the preferred embodiment, the mat 24 is made of rubber chain links 36, with cables 38 connecting the rubber links 36. Thus, the mat 24 absorbs the impact of a pitched ball 32, without damaging or marring the surface of the ball. The side edges of the mat 24 preferably are detached from the sidewalls 18 of the housing 12, or alternatively, may be loosely connected to the sidewalls 18.

As seen in FIGS. 1 and 2, the top edge of the mat 24 resides above the top wall 20 of the housing 12, with the mat extending downwardly through a slot in the top 20.

In use, the baseball pitcher 25 preferably stands on a pitching mound (not shown), with 1 foot on a pitching rubber (not shown) to simulate a game situation. A softball pitcher typically does not pitch from a mound but does have a pitching rubber. The pitcher 25 pitches the baseball or softball into the mat 24, which may include indicia for a strike zone imprinted on the rubber links 36. The mat 24 absorbs the impact of the pitched ball 32, which falls onto the sloped floor 22 and rolls into the tube 26. The tube 26 has a diameter slightly larger than the baseball or softball. Thus, a smaller tube 26 is used for a baseball and a larger tube 26 is used for a softball. Also, the tube 26 preferably only holds one ball 32 at a time. The tube 26 has an open forward end adjacent or beneath the lower edge of the mat 24, as best seen in FIG. 1. The ball 32 is "thrown" back to the pitcher 25 through the tube 26 above the floor 22.

After the pitch, the pitcher 25 actuates the air tank 28 via a switch 42 adjacent the pitching rubber, thereby providing a stream or shot of pressurized air from the air tank 28 to the tube 26 and thereby pneumatically return the ball 32 to the pitcher 25. The incline of the tube 26 assures that the ball does not hit the ground on return to the pitcher. Preferably, the switch 42 is on the ground and is actuated by the pitcher's foot. The switch 42 is coupled to the air tank 28 by any convenient means, including a hard-wired electrical line 44, or alternatively by a wireless connection. As a further alternative, the foot activated switch 42 can be replaced with a hand-operated remote controller which the pitcher 25 may keep in in any convenient location, such as in his or her pocket.

Preferably, the machine 10 also includes one or more lights 46 on the housing 12 to indicate that the machine 10 is ready for a pitch and/or ready to return the ball 32 to the pitcher 25. For example, as shown in FIG. 1, a red light 46A may indicate that the machine is inoperative, and a green light 46B may indicate that the machine is operative. The machine 10 may also include additional electronics to provide feedback to the pitcher, such as sensors (not shown) to indicate pitch speed or velocity, and/or whether the pitched ball 32 hit the strike zone imprinted on the mat 24.

A ramp 40 may be attached to the housing 12 and extend forwardly from the open front 14 so as to deflect a low-pitched ball into the housing 12.

The ball return mechanism, which includes the air tank 28, the compressor 30, and the switch 42, may include a quick release air valve with an electronic control solenoid that connects the switch 42 to the air tank 28. The switch 42 may be in the form of an electronic foot pedal, as shown in FIG. 1, or a handheld controller. The air tank 28 and the compressor 30 are located behind the housing 12 so that a bad pitch cannot hit the tank 28 or compressor 30, which would damage the ball and potential damage the return mechanism.

The machine 10 allows baseball and softball pitchers to practice and train so as to develop their skills, with unlimited time and without the need for a catcher. The pitcher-actuated return switch increases safety by returning the ball only on the pitcher's demand, when the practice area is free and clear of other people. The ball return mechanism also simulates a throw back from a real catcher fore velocity. The rubber chain link mat withstands repeated impact by hard throwing pitchers with speeds in excess of 90 mph.

The "scope" of the present disclosure is defined by the appended claims, along with the full scope of equivalents to which such claims are entitled. The scope of the disclosure is further qualified as including any possible modification to any of the aspects and/or embodiments disclosed herein which would result in other embodiments, combinations, subcombinations, or the like that would be obvious to those skilled in the art.

What is claimed is:

1. A pitched ball catch and return machine, comprising:

a housing having an open front, a back wall, opposite sidewalls, a floor, and a top;

a mat hanging downwardly in front of the back wall to absorb impact from a ball thrown by a pitcher and then drop the ball onto the floor;

the floor being sloped downwardly and rearwardly;

a tube having an inlet adjacent the floor to receive the ball from the floor and to eject the ball out of; and a pressurized air tank operatively connected to the tube to project the ball out of the inlet of the tube and back to the pitcher;

wherein the ball is ejected from the tube solely via a blast of air from the pressurized air tank.

2. The machine of claim 1 further comprising a switch to actuate the air tank.

3. The machine of claim 2 wherein the switch is remote from the housing.

4. The machine of claim 3 wherein the switch is adjacent the pitcher.

5. The machine of claim 4 wherein the switch foot-actuated by the pitcher.

6. The machine of claim 1 wherein the mat is a rubber chain link material.

7. The machine of claim 1 further comprising an inclined ramp extending downwardly and forwardly from the floor to direct the ball into the housing when the ball is thrown too low.

8. The machine of claim 1 further comprising wheels on the housing to roll the machine from one location to another location.

9. The machine of claim 1 wherein the tube has a diameter larger than the ball.

10. The machine of claim 1 wherein the tube has forward and rearward ends, and is upwardly inclined from the rearward end to the forward end and the inlet is at the forward end.

11. The machine of claim 1 wherein the mat has an upper edge, a lower edge, and opposite side edges, and is supported only at the upper edge.

12. The machine of claim 1 wherein the housing, mat, floor, tube, and air tank are all connected to form an integral unit.

13. The machine of claim 1 wherein the air tank is behind the back wall of the housing.

14. The machine of claim 1 wherein the housing includes lights to indicate that the machine is ready to catch and return a pitched ball.

15. A pitching practice method for pitching a ball by a pitcher, comprising:

throwing the ball against a mat hung in a housing so that the ball drops to a sloped floor and rolls into an open end of a tube connected to a pressurized air tank; and the pitcher stepping on a switch to actuate the air tank whereby the ball is pneumatically projected out of the open end of the tube and back to the pitcher, wherein the ball both enters the tube and exits the tube from the open end of the tube.

16. The pitching practice method of claim 15 wherein the pitcher throws from a pitching rubber.

17. The pitching practice method of claim 16 wherein the switch is adjacent the pitching rubber.

18. The pitching practice method of claim 15 wherein the pitcher steps on the switch after a light indicates that air tank is ready to return the ball.

19. The pitching practice method of claim 15 wherein speed of each pitch is recorded.

20. The pitching practice method of claim 15 wherein location of the ball on the mat is recorded for each pitch.

* * * * *